US008850835B2

(12) United States Patent
Flanigan

(10) Patent No.: US 8,850,835 B2
(45) Date of Patent: Oct. 7, 2014

(54) RECIPROCATING REFRIGERATION COMPRESSOR OIL SEPARATION

(75) Inventor: Paul J. Flanigan, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 83 days.

(21) Appl. No.: 13/512,963

(22) PCT Filed: Dec. 13, 2010

(86) PCT No.: PCT/US2010/060010
§ 371 (c)(1),
(2), (4) Date: May 31, 2012

(87) PCT Pub. No.: WO2011/084369

PCT Pub. Date: Jul. 14, 2011

(65) Prior Publication Data

US 2013/0031929 A1 Feb. 7, 2013

Related U.S. Application Data

(60) Provisional application No. 61/292,764, filed on Jan. 6, 2010.

(51) Int. Cl.

| | |
|---|---|
| ***F25B 43/02*** | (2006.01) |
| ***F04B 39/04*** | (2006.01) |
| ***F04B 39/16*** | (2006.01) |
| ***F25B 31/02*** | (2006.01) |
| *F25B 1/02* | (2006.01) |

(52) U.S. Cl.

CPC ..... *F25B 9/088* (2013.01); *F25B 43/02* (2013.01); *F04B 39/04* (2013.01); *F04B 39/16* (2013.01); *F25B 1/02* (2013.01); *F25B 31/023* (2013.01)

USPC ..... 62/84; 62/468

(58) Field of Classification Search

CPC ..... F25B 31/002; F25B 43/00; F04B 39/04; F04B 39/016; F04B 9/008; F04B 31/023; F04B 43/02; F04B 1/02

USPC ..... 62/84, 468, 498, 193, 469; 417/53, 415, 417/363

See application file for complete search history.

(56) References Cited

U.S. PATENT DOCUMENTS

| | | | |
|---|---|---|---|
| 1,949,505 | A | 3/1934 | Warren |
| 2,256,926 | A | 9/1941 | Maniscalco |

(Continued)

FOREIGN PATENT DOCUMENTS

| | | | |
|---|---|---|---|
| DE | 2250947 | A1 | 5/1974 |
| EP | 1947335 | A2 | 7/2008 |

(Continued)

OTHER PUBLICATIONS

International Search Report and Written Opinion for PCT/US2010/060010, dated Nov. 3, 2011.

(Continued)

*Primary Examiner* — Mohammad M Ali

(74) *Attorney, Agent, or Firm* — Bachman & LaPointe, P.C.

(57) ABSTRACT

A compressor (20) has a case (22) and a crankshaft (38). The case has a number of cylinders (30, 32). For each of the cylinders, the compressor includes a piston (34) mounted for reciprocal movement at least partially within the cylinder. A connecting rod (36) couples each piston to the crankshaft. An electric motor compartment (50) of the case has a stator (42) and a rotor (40). The rotor is mounted to the crankshaft. The case has a wall (56) between the motor compartment and a crankcase compartment/sump (52). The wall bears a feature (120, 132; 420; 460) for coalescing oil entrained in a refrigerant flow (522), which flow exits the gap (90) between the rotor and the stator to prevent the oil from entering the cylinders.

20 Claims, 10 Drawing Sheets

(56) References Cited

U.S. PATENT DOCUMENTS

| | | | | |
|---|---|---|---|---|
| 2,264,847 | A | 12/1941 | Johnson | |
| 3,253,776 | A * | 5/1966 | Parker | 184/6 |
| 3,385,515 | A * | 5/1968 | Parker | 417/312 |
| 3,844,688 | A | 10/1974 | Bulkley et al. | |
| 3,906,603 | A * | 9/1975 | Romer et al. | 29/888.025 |
| 3,985,475 | A * | 10/1976 | Gatecliff | 417/539 |
| 4,252,506 | A * | 2/1981 | Hannibal | 417/419 |
| 4,325,679 | A * | 4/1982 | Smith | 417/372 |
| 4,386,859 | A * | 6/1983 | Andrione et al. | 384/420 |
| 4,887,514 | A | 12/1989 | Schintgen | |
| 5,062,773 | A | 11/1991 | Kawai et al. | |
| 5,159,820 | A | 11/1992 | Ohishi et al. | |
| 5,170,640 | A | 12/1992 | Heitmann et al. | |
| 5,591,011 | A | 1/1997 | Mantooth et al. | |
| 5,809,866 | A | 9/1998 | Brascher et al. | |
| 6,126,411 | A | 10/2000 | Flanigan et al. | |
| 6,131,406 | A | 10/2000 | Barowsky et al. | |
| 6,178,873 | B1 * | 1/2001 | Pierobon et al. | 92/187 |
| 6,237,362 | B1 | 5/2001 | Jang | |
| 6,807,821 | B2 | 10/2004 | Narney, II | |
| 7,044,717 | B2 * | 5/2006 | Dreiman et al. | 417/366 |
| 7,082,785 | B2 | 8/2006 | Nieter et al. | |
| 7,137,788 | B2 | 11/2006 | Goodell | |
| 7,144,229 | B2 * | 12/2006 | Ishida et al. | 417/415 |
| 2007/0253854 | A1 | 11/2007 | Dunn | |
| 2009/0185928 | A1 | 7/2009 | Bush et al. | |

FOREIGN PATENT DOCUMENTS

| | | | |
|---|---|---|---|
| JP | 3-185278 | A | 8/1991 |
| SU | 901768 | A1 | 5/2012 |

OTHER PUBLICATIONS

WPI Abstract of SU901768, Thomson Scientific, 1982.

Chinese Office Action for CN Patent Application No. 201080060811.0, dated May 1, 2014.

* cited by examiner

RECIPROCATING REFRIGERATION COMPRESSOR OIL SEPARATION

CROSS-REFERENCE TO RELATED APPLICATION

Benefit is claimed of U.S. Patent Application Ser. No. 61/292,764, filed Jan. 6, 2010, and entitled "Reciprocating Refrigeration Compressor Oil Separation", the disclosure of which is incorporated by reference herein in its entirety as if set forth at length.

BACKGROUND

The present disclosure relates to refrigeration compressors. More particularly, it relates to hermetic reciprocating piston compressors. A variety of refrigerant compressor configurations are in common use. Among these configurations are: screw compressors; scroll compressors; and reciprocating piston compressors.

In closed-drive or hermetic compressors, an electric motor is contained within the compressor's case. In such compressors, the crankshaft is fully internal to the case and does not need to be sealed relative to the case. In other (open-drive) compressors, the motor (whether electric or other) is external to the case and the crankshaft penetrates the case. An external portion of the crankshaft is mechanically coupled to the motor. In such situations, a portion of the crankshaft penetrating the case must be sealed to the case.

Two particular subfields of refrigeration systems wherein reciprocating compressors are often used are: as central compressors for distributed retail display cabinets; and in transport refrigeration systems (e.g., truck, trailer, and cargo container refrigeration systems). An exemplary state of the art transport refrigeration system uses a diesel-electric hybrid system to electrically power a reciprocating piston compressor which uses R-404A HFC refrigerant. More recently, it has been proposed to use carbon dioxide-based refrigerants (e.g., R-744) due to concerns regarding the environmental impact of HFCs.

SUMMARY

One aspect of the disclosure involves a compressor having a case and a crankshaft. The case has an inlet, number of cylinders, an outlet, a motor compartment, a suction passage between the motor compartment and the cylinders, and a crankcase compartment. For each of the cylinders, the compressor includes a piston mounted for reciprocal movement at least partially within the cylinder. A connecting rod couples each piston to the crankshaft. An electric motor is within a motor compartment of the case and includes a stator and a rotor. The rotor is mounted to the crankshaft. The case has a wall between the motor compartment and a crankcase compartment/sump. The wall bears means for coalescing oil entrained in a flow, which flow exits a gap between the rotor and the stator. This prevents the oil from entering the cylinders via the suction passage.

In various implementations, the compressor may further include a bearing mounted within the wall and supporting the crankshaft. A check valve may be in the wall below the bearing.

Other aspects of the disclosure involve a refrigeration system including such a compressor. The refrigeration system may include a recirculating flowpath through the compressor. A first heat exchanger may be positioned along the flowpath downstream of the compressor. An expansion device may be positioned along the flowpath downstream of the first heat exchanger. A second heat exchanger may be positioned along the flowpath downstream of the expansion device. The refrigerant charge may comprise at least 50% carbon dioxide by weight. The system may be a refrigerated transport system. The refrigerated transport system may further comprise a container. The second heat exchanger may be positioned to cool an interior of the container. The system may be a fixed refrigeration system. The fixed refrigeration system may further comprise multiple refrigerated spaces. There may be a plurality of said second heat exchangers, each being positioned to cool an associated such refrigerated space.

Other aspects of the disclosure involve methods of use. The motor is powered to drive the crankshaft and provide the reciprocal movement of the pistons. The movement of the pistons creates suction in a suction passage. The suction draws the refrigerant and the oil entrained in the refrigerant into the compressor through the inlet. At least a portion of the refrigerant and entrained oil passes longitudinally toward the wall through a space between the rotor and the stator. The means cause a deflection of the flow. The deflection of the flow causes separation and the coalescing of the oil.

This may be implemented in the reengineering a configuration of a compressor or remanufacturing the compressor, by adding a lip to form the means for coalescing oil to produce the compressor or the configuration of said compressor.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
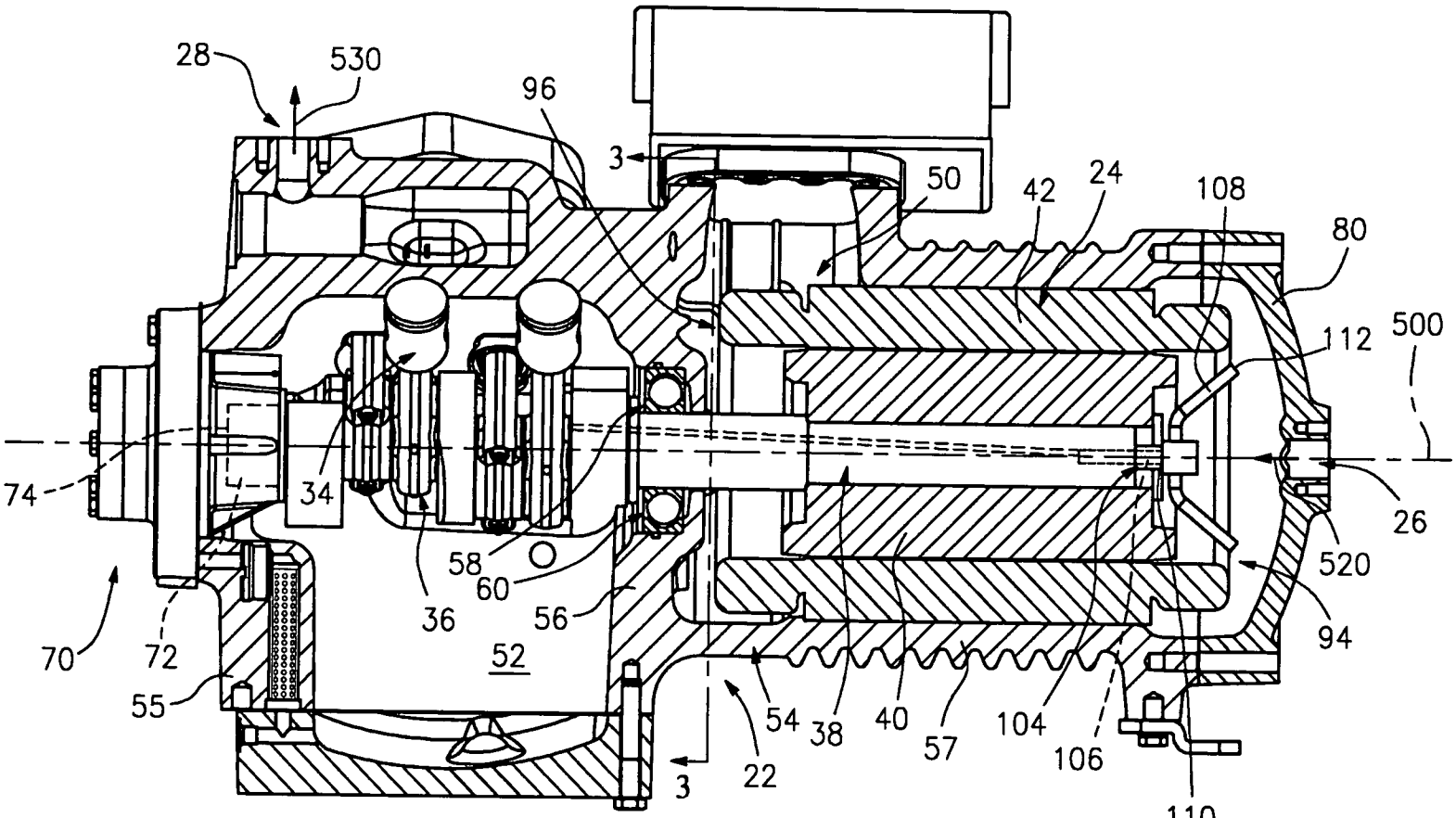
FIG. 1 is a vertical longitudinal sectional/cutaway view of a compressor.
Figure 2:
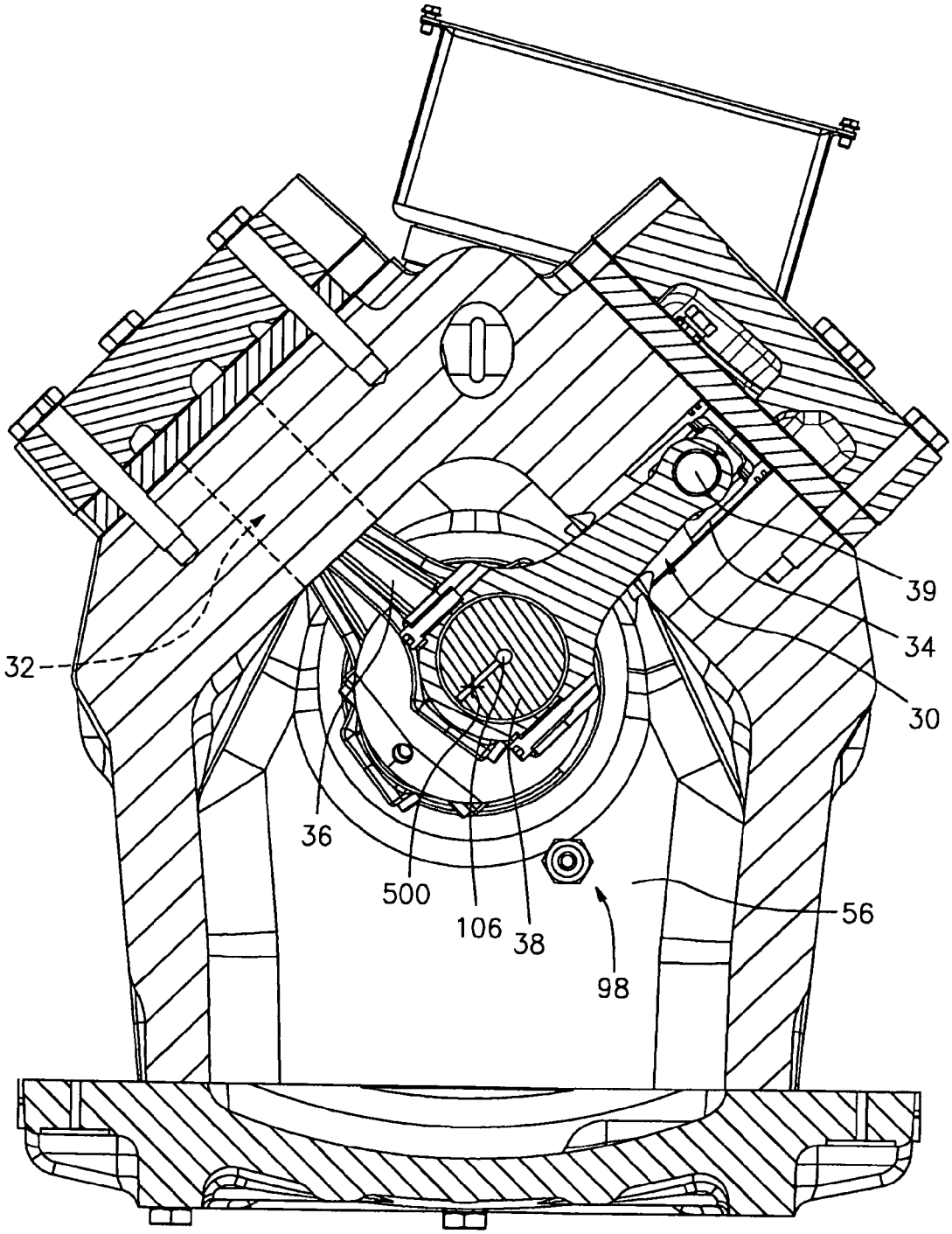
FIG. 2 is a vertical transverse sectional view of the compressor of FIG. 1.

FIGS. 1 and 2 show an exemplary compressor 20. The compressor 20 has a housing (case) assembly 22. The exemplary compressor includes an electric motor 24 (FIG. 1). The exemplary case 22 has a suction port (inlet) 26 and a discharge port (outlet) 28. The housing defines a plurality of cylinders 30 and 32 (FIG. 2). Each cylinder accommodates an associated piston 34 mounted for reciprocal movement at least partially within the cylinder. Exemplary multi-cylinder configurations include: in-line; V (vee); and horizontally opposed. The exemplary vee compressor includes two banks of two cylinders each. Each of the cylinders includes a suction location and a discharge location. For example, the cylinders may be coupled in parallel so that the suction location is shared/common suction plenum fed by the suction port 26 and the discharge location is a shared/common discharge plenum feeding the discharge port 28. In other configurations, the cylinders may share suction locations/conditions but have different discharge locations/conditions. In other configurations, the cylinders may be in series. Exemplary refrigerant is carbon dioxide ($CO_2$)-based (e.g., at least 50% $CO_2$ by mass/weight).

Each of the pistons 34 is coupled via an associated connecting rod 36 to a common crankshaft 38. Each piston 34 is coupled to its associated connecting rod 36 via an associated wrist pin 39. The exemplary crankshaft 38 is held within the case by bearings for rotation about an axis 500. The exemplary crankshaft 38 (FIG. 1) is coaxial with a rotor 40 and stator 42 of the motor 24.

The exemplary case defines a motor compartment 50 and a crankcase or sump compartment 52. The exemplary case assembly comprises a single main casting 54 along the cylinders, the sides of the crankcase and laterally surrounding the motor compartment. Depending upon context, the term "crankcase" may identify the compartment 52 or the structure surrounding such compartment (e.g., including a crankcase portion 55 of the main casting 54). The main casting includes a wall 56 dividing the crankcase 52 from the motor compartment 50. The exemplary main casting 54 also includes a motor case portion 57 surrounding the motor for at least half a length of the stator and rotor. The exemplary wall 56 has a bearing compartment 58 carrying a bearing 60 supporting the crankshaft relative to the case.

At a front end of the crankcase 52, an aperture in the main casting is closed by a front bearing assembly 70 which engages a forward portion 72 of the crankshaft near a front end 74 thereof. Such assembly 70 may be integrated with an oil pump or other features.

At the rear/distal end of the motor compartment 50, a motor cover 80 is secured to the main casting 54. The cover 80 may contain the compressor inlet 26. The motor compartment 50 is coupled to the cylinders via suction passages 82. Cylinder reciprocation draws refrigerant through the inlet 26 (at 520 in FIG. 1), into the motor compartment 50, from the motor compartment 50 through the suction passages 82 (at 526 in FIG. 3), through the cylinders, and then out through a discharge plenum to the outlet 28 (at 530 in FIG. 1). When passing through the cylinders, the refrigerant flow entrains additional oil so that the compressor discharge flow at 530 is relatively oil rich compared with the flow at 526. As is discussed further below, it is known in the art to have oil separators downstream of the compressor to remove oil from the refrigerant flow and return it to the compressor. By removing the oil from the refrigerant flow, heat exchanger efficiency may be improved.

Figure 4:
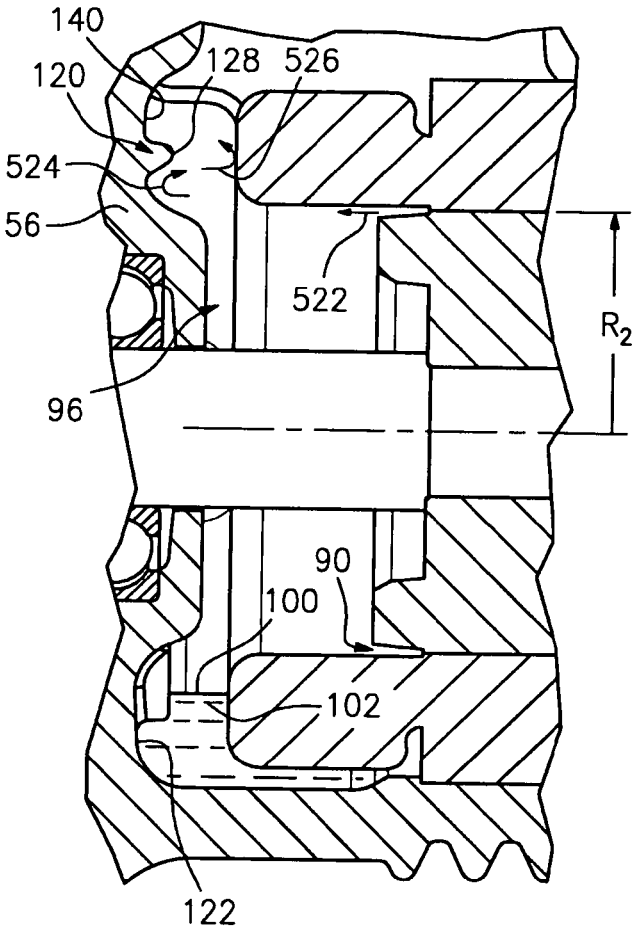
FIG. 4 is a first enlarged view of a proximal end of the motor compartment of the compressor of FIG. 1.
Figure 5:
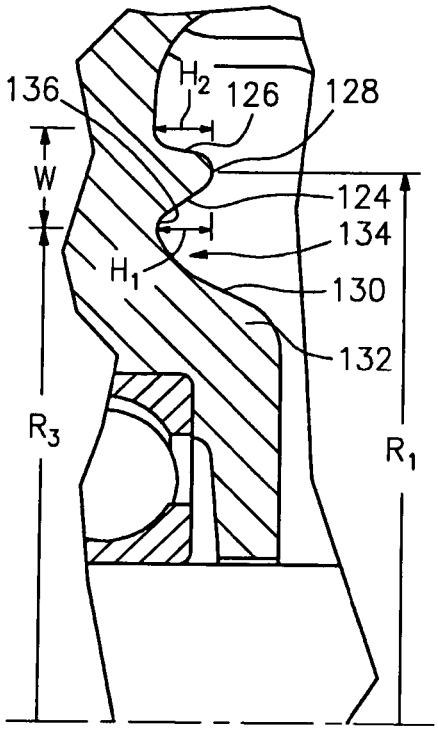
FIG. 5 is a further enlarged view of the proximal end of the motor compartment.

In an exemplary compressor, the refrigerant is drawn through an annular space (air gap) 90 (FIG. 4) between the rotor 40 and stator 42 from a distal (away from the crankcase) end 94 of the motor (FIG. 1) to a proximal (near the crankcase) end 96 of the motor.

The exemplary compressor has means for coalescing oil entrained in the flow 522 exiting the air gap. This helps prevent such oil from entering the cylinders via the suction passages. Separating the oil within in the motor compartment (e.g., as distinguished from only having a separate separator) may have several advantages. Existing hermetic compressors have means for returning oil from the motor compartment to the crankcase. Specifically, in many existing compressors, a check valve 98 (FIG. 2) may be positioned in the wall 56 to permit one way flow from the motor compartment into the crankcase. The check valve inlet 99 (FIG. 3) may be positioned at the level of a surface 100 desired maximum oil accumulation 102 in the motor compartment. The crankcase may be maintained at a slightly lower pressure than the motor compartment in order to draw oil from the motor compartment into the crankcase through the check valve. An exemplary means for drawing the oil into the crankcase comprises a centrifugal pump 104 (FIG. 1) integrated with the crankshaft. The pump 104 includes a passageway 106 extending within the crankshaft between the crankcase and motor compartment. At the motor compartment, the passageway communicates with a generally C-shaped radially extending suction tube 108 (having a central inlet 110 along the crankshaft and a pair of radially opposite outlets 112 at the ends of the "C"). As the suction tube rotates with the crankshaft, it draws from the passageway 106 to lower the pressure in the crankcase relative to the motor compartment. Reduced pressure in the crankcase draws the oil from the motor compartment through the check valve. Thus, in modifying such a system, the addition of oil separation in the crankcase does not require the addition of separate return mechanism. The separated oil may be returned to the crankcase through the existing check valve.

Another advantage is that, if a sufficient amount of oil is removed from the flow in the motor compartment, an external separator may either be eliminated or downsized (thereby reducing system manufacturing costs).

The exemplary means for coalescing is provided by adding a generally annular lip 120 (FIG. 4) along the (axially) outboard surface 122 of the wall 56. The lip has a radially inboard surface 124, an outboard surface 126, and a rim/apex 128. The inboard surface 124 cooperates with an outboard surface 130 of a bearing boss 132 protruding from the wall to form a generally annular channel 134. The channel 134 has a base 136 along the wall 56. As is discussed further below, the exemplary lip 120 is less than a full annulus, having a lower gap 138 which may accommodate the check valve and which may approximately coincide with the surface 100 of the oil accumulation in the motor compartment.

Figure 3:
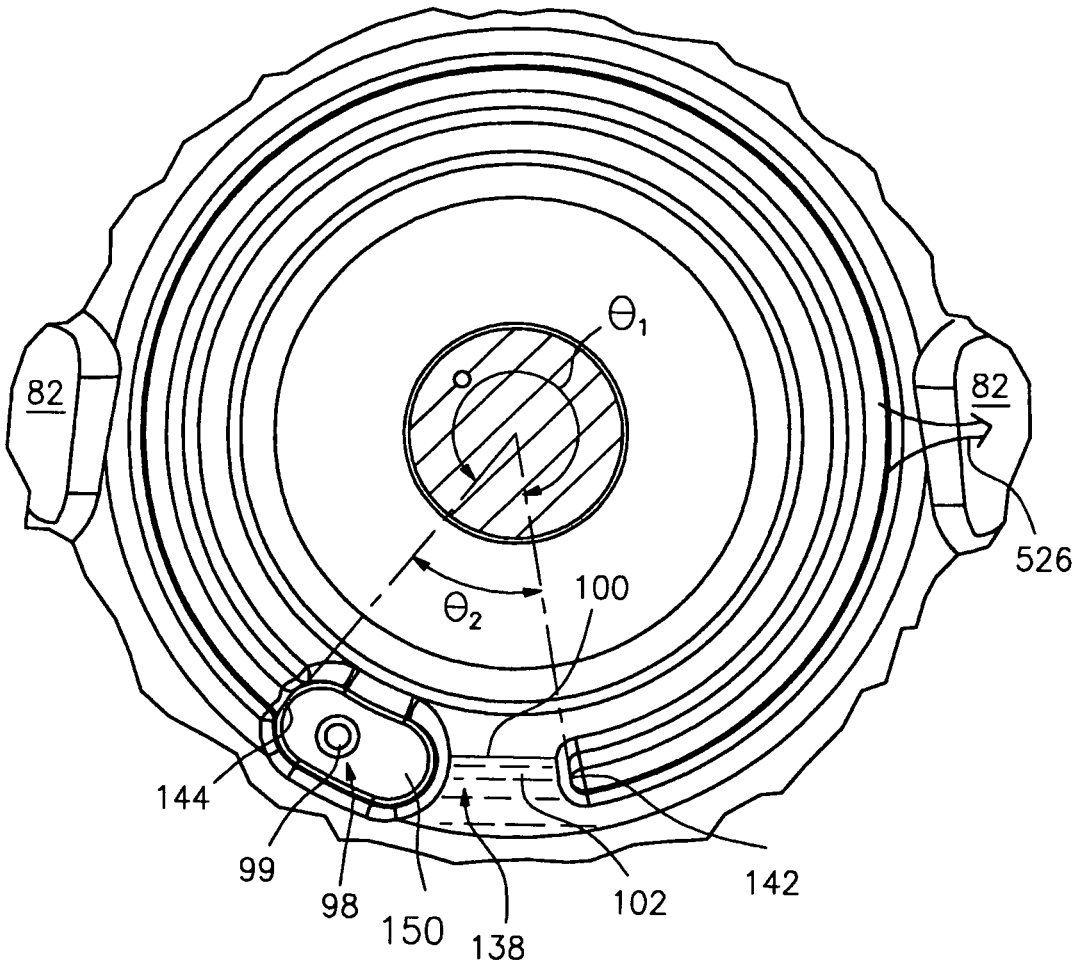
FIG. 3 is a partial second vertical transverse sectional view of the compressor of FIG. 1.

In the exemplary embodiment, a flow 520 (FIG. 1) of oil-laden refrigerant enters the inlet. At least a portion 522 (FIG. 4) is drawn through the air gap. The refrigerant exiting the air gap is deflected radially outward by the boss outer surface and then deflected longitudinally backward by the channel base and lip inboard surface. This reversing portion of the flowpath is shown as 524. The flow reversal may cause oil (previously entrained in the refrigerant) to coalesce along the channel wall and flow downward into the accumulation. The refrigerant flow may reverse back (e.g., 526) to enter the suction passages 82 (FIG. 3). At this point, the refrigerant flow is depleted of oil relative to the inlet flow 526.

The channel 134 (FIG. 4) has an exemplary height or depth (relative to the lip rim) of $H_1$ (i.e., the lip height as measured from the channel base). A lip height $H_2$ relative to an outboard portion 140 of the wall may be close to or the same as $H_1$. It may be desirable to maximize height to maximize the available surface area for coalescing, subject to available clearances, casting practicalities, and material cost. Exemplary $H_2$ and $H_1$ are 5-20 mm, more narrowly, 8-12 mm. Relative to a lip width W (e.g., measured trough-to-trough), exemplary $H_2$ and $H_1$ are 50%+ of W (e.g., 50-200%), more narrowly at least 100% An exemplary circumferential extent $\theta_1$ of the lip (e.g., from end 142 to end 144) is at least 180°, more particularly, at least 270°, or 270-330° (if less than a full annulus). The geometry of the particular compressor shown suggests having a gap 138 in the lip. This is because the radial position of the lip is determined based upon the position of the motor's air gap. A given desired height of the oil surface 100, may place a portion of a full annulus lip in the accumulation. The casting material in this area would be wasted. Additionally, it may be desired to locate the check valve 98 at or near the lip. For example, the exemplary check valve is positioned along a large flat boss 150. The exemplary boss 150 falls along the gap. The boss 150 is oversized relative to the check valve to provide flexibility in location of the check valve (i.e., for a given casting, one can drill the hole for the check valve at a desired height along the boss so as to provide an advantageous check valve location for particular target operating conditions). Thus, if less than a full annulus, an exemplary gap angle $\theta_2$ may be 30-120°, more narrowly, 40-60°. A radial position $R_1$ of the lip rim 128 may be greater than a radial position $R_2$ of the center of the air gap (more narrowly, greater than $R_2+H_1$) but less than the outer radius of the stator. Alternatively measured, $R_1$ may be an exemplary 105-120% of $R_2$, more narrowly, 107-115%. The exemplary lip rim 128 may also be at an exemplary 105%+ of a radial position $R_3$ of the base of the channel, more narrowly, 110-130% or 110-120%. Exemplary $R_3$ is 105-120% of $R_2$. In the exemplary system, the crankshaft axis 500 is essentially horizontal (e.g., within 20° of horizontal, more narrowly, within 5° of horizontal).

Figure 6:
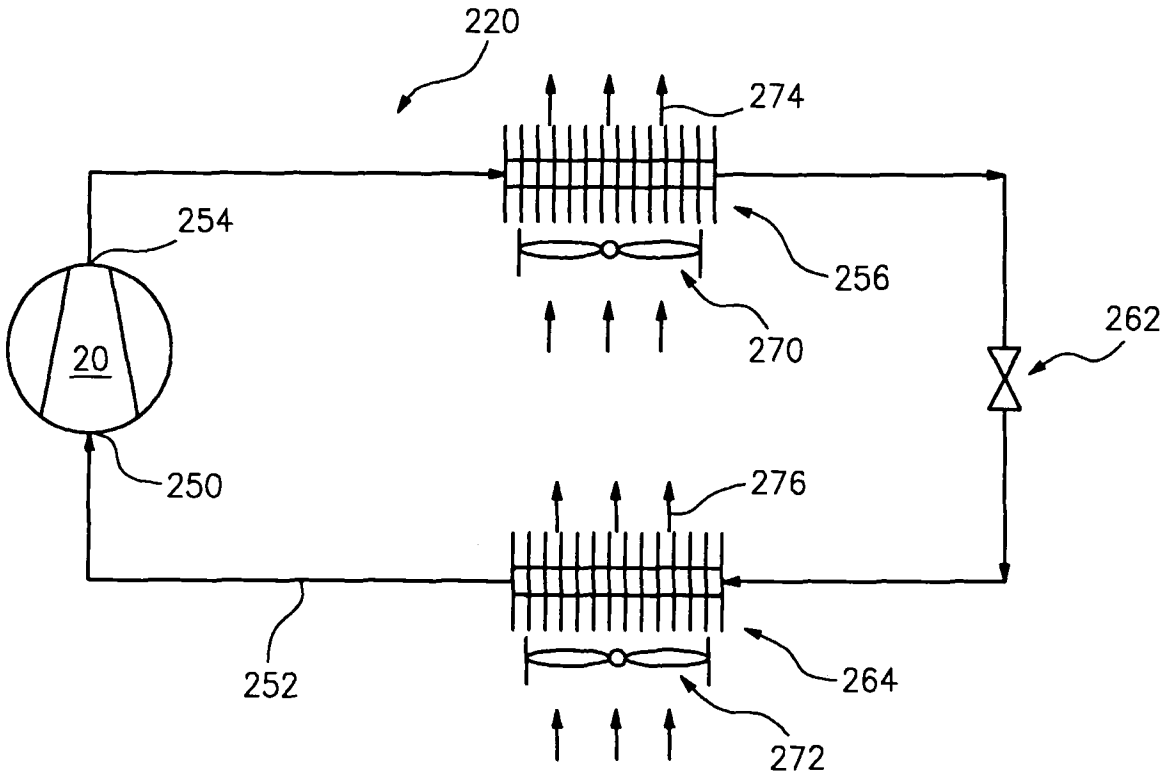
FIG. 6 is a schematic view of a refrigeration system.

The lip may be implemented in a reengineering of an existing compressor configuration by simply adding a corresponding channel in the sand casting mold. Alternatively, the lip may be implemented as a separate piece (e.g. the rim of a plate mounted to the wall). Such a plate may also be used in a remanufacturing of an existing compressor. The plate may be provided with appropriate apertures or cutouts to accommodate components such as the check valve. Such a plate might be stamped of sheet metal. Appropriate lip dimensions and shapes may be worked out via iterative experiments on-hardware or computer fluid dynamics simulation FIG. 6 shows an exemplary refrigeration system 220 including the compressor 20. The system 220 includes a system suction location/condition 250 at the suction port 26. A refrigerant primary flowpath 252 proceeds downstream from the suction location/condition 250 through the compressor cylinders in parallel to be discharged from a discharge location/condition 254 at the discharge port 28. The primary flowpath 252 proceeds downstream through the inlet of a first heat exchanger (gas cooler/condenser) 256 to exit the outlet of the gas cooler/condenser. The primary flowpath 252 then proceeds downstream through an expansion device 262. The primary flowpath 252 then proceeds downstream through a second heat exchanger (evaporator) 264 to return to the suction condition/location 250.

In a normal operating condition, a recirculating flow of refrigerant passes along the primary flowpath 252, being compressed in the cylinders. The compressed refrigerant is cooled in the gas cooler/condenser 256, expanded in the expansion device 262, and then heated in the evaporator 264. In an exemplary implementation, the gas cooler/condenser 256 and evaporator 264 are refrigerant-air heat exchangers with associated fan (270; 272)-forced airflows (274; 276). The evaporator 264 may be in the refrigerated space or its airflow may pass through the refrigerated space. Similarly, the gas cooler/condenser 256 or its airflow may be external to the refrigerated space.

Additional system components and further system variations are possible (e.g., multi-zone/evaporator configurations, economized configurations, and the like). Exemplary systems include refrigerated transport units and fixed commercial refrigeration systems.

Figure 7:
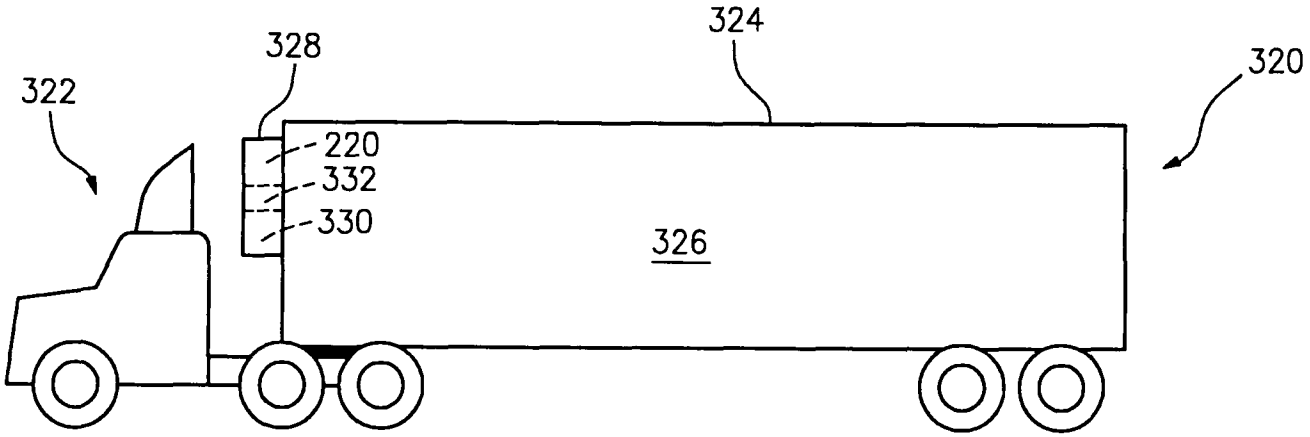
FIG. 7 is a partially schematic view of a tractor trailer combination including the system of FIG. 6.

FIG. 7 shows a refrigerated transport unit (system) 320 in the form of a refrigerated trailer. The trailer may be pulled by a tractor 322. The exemplary trailer includes a container/box 324 defining an interior/compartment 326 (the refrigerated space). An equipment housing 328 mounted to a front of the box 324 may contain an electric generator system including an engine 330 (e.g., diesel) and an electric generator 332 mechanically coupled to the engine to be driven thereby. The refrigeration system 220 may be electrically coupled to the generator 332 to receive electric power. The evaporator and its associated fan may be positioned in or otherwise in thermal communication with the compartment 326.

Figure 8:
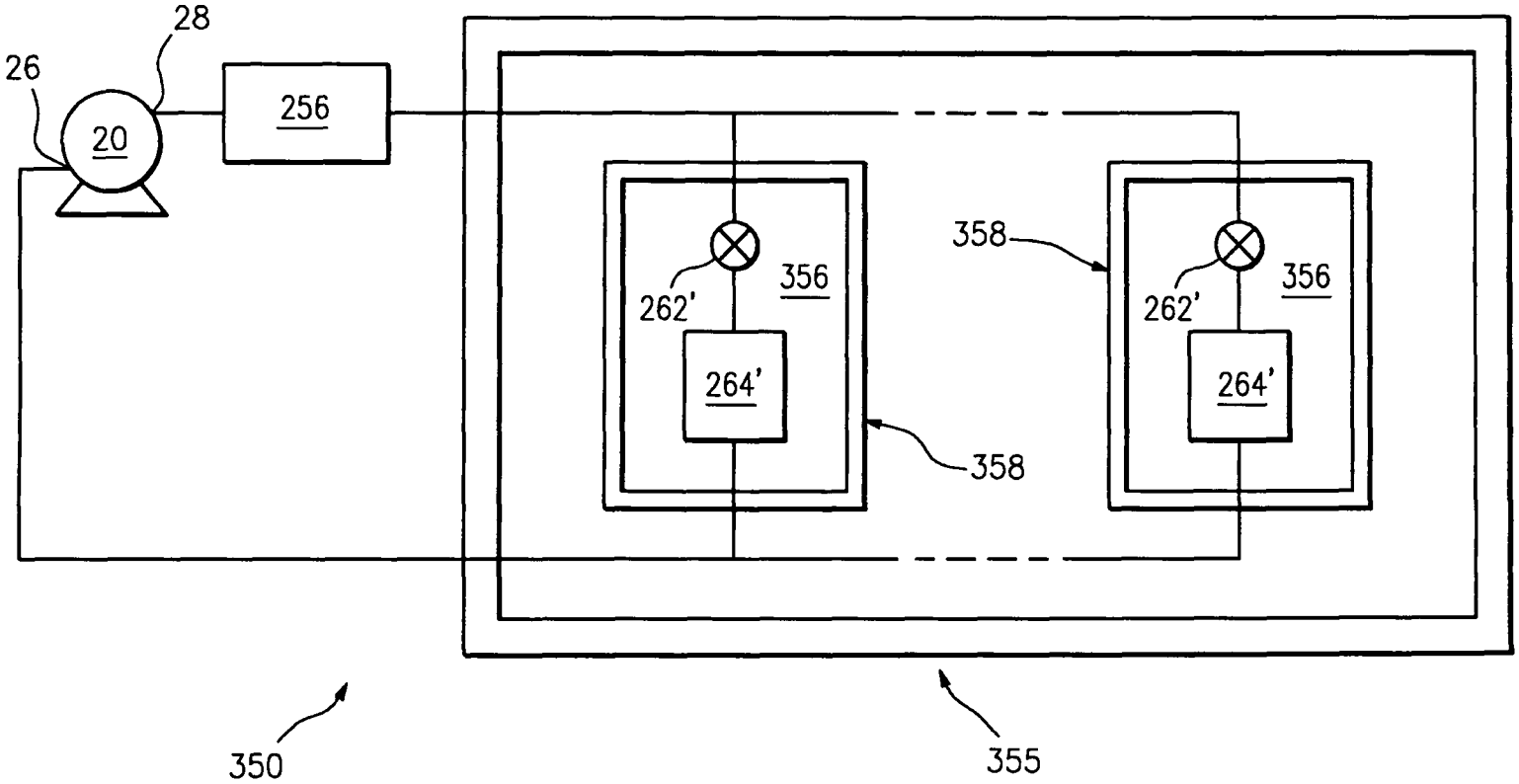
FIG. 8 is a schematic view of a fixed commercial refrigeration system.

An exemplary fixed commercial refrigeration system 350 (FIG. 8) includes one or more central compressors 20 and heat rejection heat exchangers 256 (e.g., outside/on a building 355) commonly serving multiple refrigerated spaces 356 (e.g., of retail display cabinets 358 in the building). Each such refrigerated space may have its own heat absorption heat exchanger 264' and expansion device 262' (or there may be a common expansion device).

The compressor may be manufactured via otherwise conventional manufacturing techniques.

Figure 9:
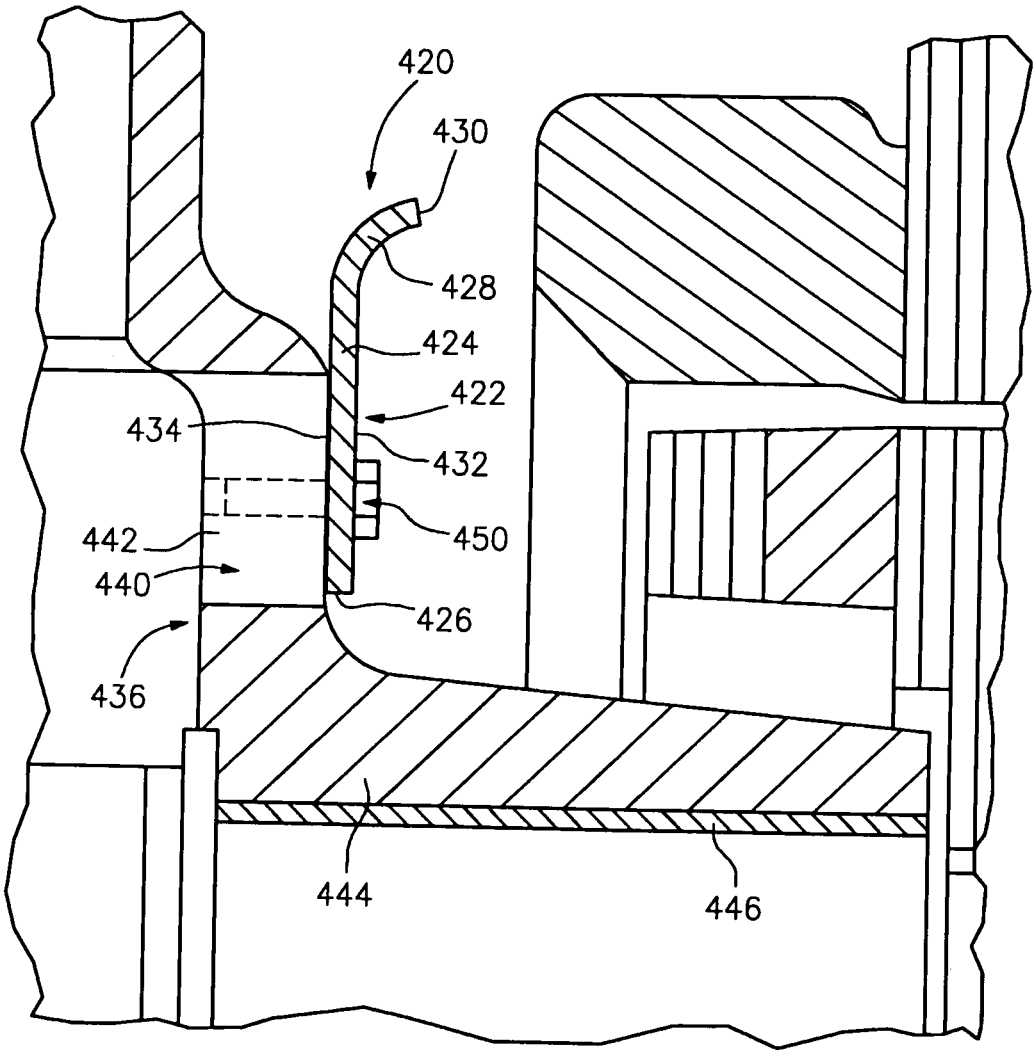
FIG. 9 is a partial longitudinal sectional/cutaway view of a proximal end of a motor compartment of an alternate compressor.

FIG. 9 shows an alternate implementation wherein the lip 420 is formed not in the casting but by a separate member (e.g., a plate 422). The exemplary plate 422 has a web 424 extending radially outward from a central aperture surface 426 (which surrounds the bearing boss with a bushing-style bearing rather than a ball bearing, the boss is relatively longer and more upstream-projecting than the boss of FIG. 1). At an outboard extreme of the web 424, a peripheral portion 428 curves longitudinally/axially outward to a rim 430 which forms a rim of the lip 420. The exemplary plate 422 has respective distal 432 and proximal 434 faces. The plate may be formed of metal (e.g., stamping from sheet metal). The plate is used in an exemplary situation where the wall 436 between the crankcase and motor case is relatively open. The exemplary wall 436 has a circumferential array of apertures 440 separated by radial webs 442 outboard of a hub-like bearing boss 444. The exemplary bearing 446 is a bushing held within the boss. The plate may be secured to the wall via fasteners such as bolts 450. The plate may be implemented in a retrofit of an existing compressor or a reengineering/redesign of an existing compressor configuration. For example, the presence of the apertures or other factors regarding the shape of the wall may require substantial changes to the casting for the lip to be implemented as part of the casting. The exemplary plate may be easier to implement. The exemplary plate may fully or partially block some or all of the apertures 440 to provide the deflection of lubricant-laden refrigerant exiting the air gap.

Figure 10:
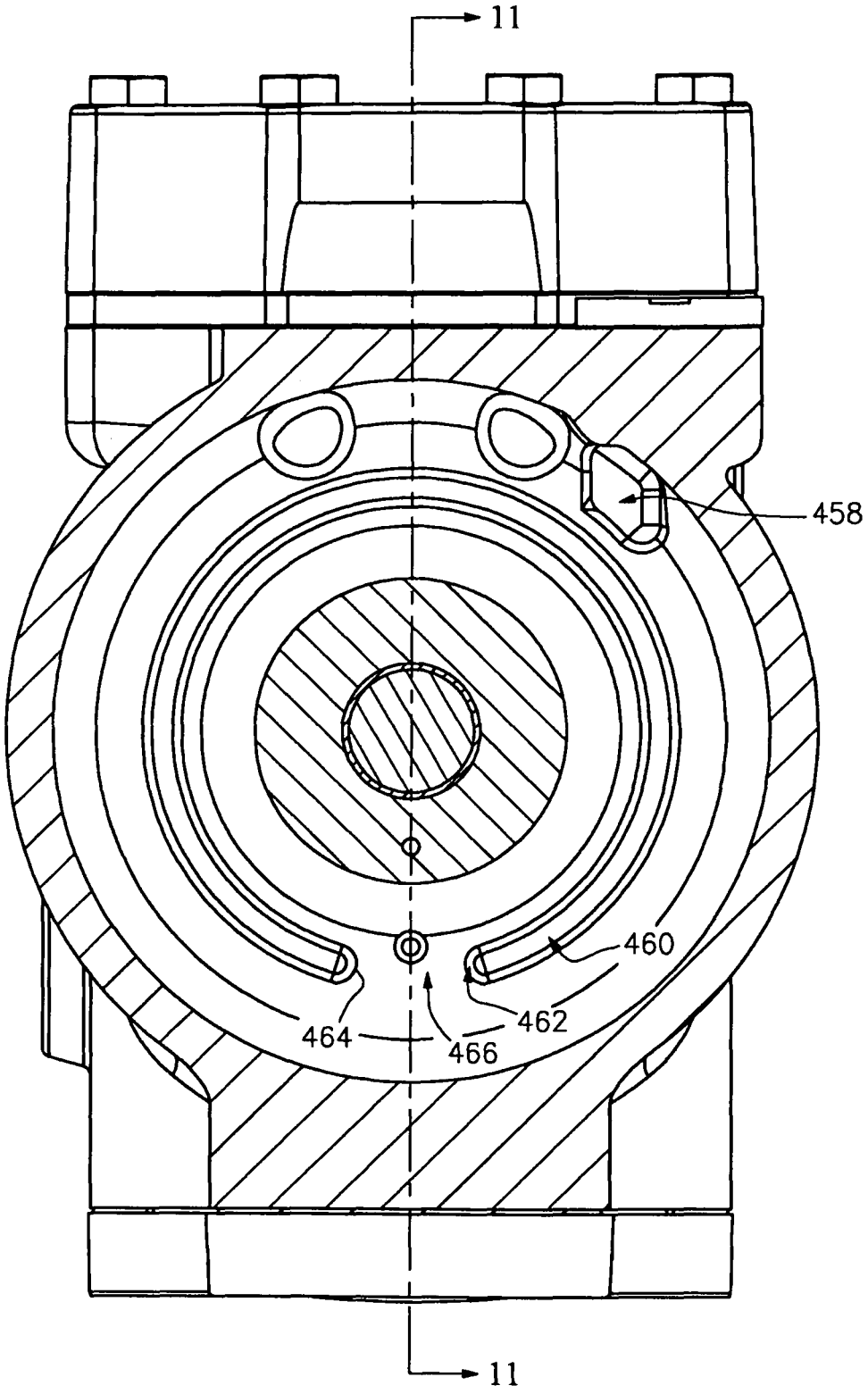
FIG. 10 is a partial longitudinal sectional/cutaway view of a proximal end of a motor compartment of a second alternate compressor.
Figure 11:
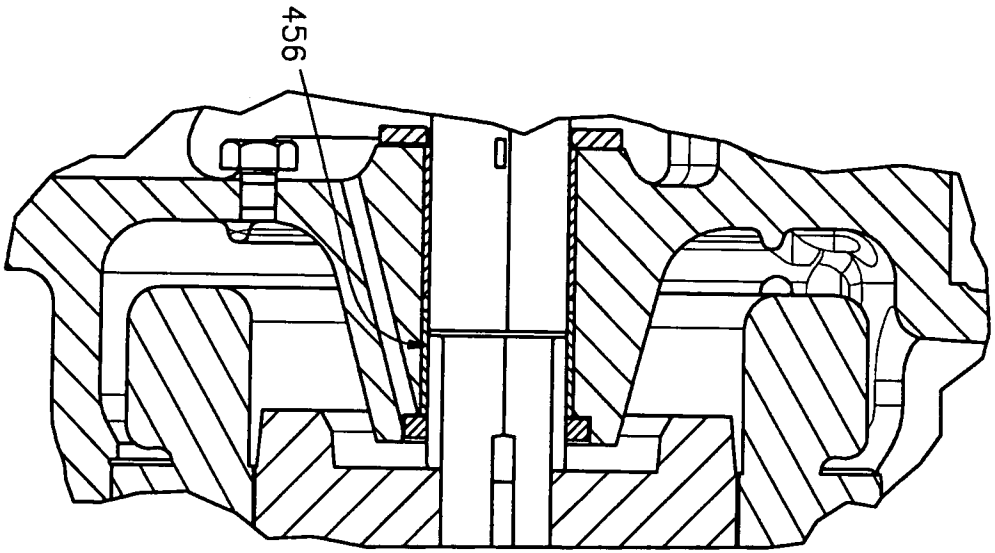
FIG. 11 is a partial longitudinal sectional/cutaway view of the proximal end of the motor compartment of the second alternate compressor of FIG. 10 taken along line 11-11.

FIGS. 10 and 11 show a second alternate compressor which also features a bushing-style bearing 456 rather than a ball bearing. The exemplary compressor also is an inline configuration with associated port 458 positioning. The lip 460 has ends 462 and 464. The gap 466 is centrally located at the lowest portion of the lip and accommodating a similar valve to that other lip above.

Although an embodiment is described above in detail, such description is not intended for limiting the scope of the present disclosure. It will be understood that various modifications may be made without departing from the spirit and scope of the disclosure. For example, when implemented in the reengineering of an existing compressor configuration, details of the existing configuration may influence or dictate details of any particular implementation. Accordingly, other embodiments are within the scope of the following claims.

What is claimed is:

1. A compressor (20) comprising:

a case (22) having:

an inlet;

a motor compartment (50);

a plurality of cylinders (30-32);

a suction passage (82) between the motor compartment and the cylinders;

a crankcase compartment (52); and an outlet;

a crankshaft (38);

for each of said cylinders:

a piston (34) mounted for reciprocal movement at least partially within the cylinder;

a connecting rod (36) coupling the piston to the crankshaft; and a pin (44) coupling the connecting rod to the piston; and an electric motor (24) within the motor compartment and comprising:

a stator (42); and a rotor (40) mounted to the crankshaft, the case having a wall (56) between the motor compartment (50) and the crankcase compartment (52);

wherein:

the wall bears means (120, 132; 420; 460) for coalescing oil entrained in a flow exiting a gap (90) between the rotor and the stator to prevent the oil from entering the cylinders via the suction passage.

2. The compressor of claim 1 further comprising:

a bearing (60) mounted within the wall and supporting the crankshaft; and a check valve (98) in the wall below the bearing to permit flow from the motor compartment into the crankcase compartment.

3. The compressor of claim 1 wherein:

the case comprises a single main casting (54), the single main casting including:

the wall (56);

a motor case (57) surrounding at least half a length of the stator and the rotor; and a crankcase (55), of which the wall (56) forms a portion.

4. The compressor of claim 1 wherein:

the means comprises a surface having a first portion (130) deflecting the refrigerant radially outward and a second portion (124) deflecting the refrigerant longitudinally backward.

5. The compressor of claim 1 wherein:

the means comprises a lip.

6. The compressor of claim 5 wherein:

the lip is a generally annular lip and has a gap (138; 466) at a lower end.

7. A refrigeration system (220; 350) comprising:

the compressor (20) of claim 1;

a refrigerant recirculating flowpath (252) through the compressor;

a first heat exchanger (256) along the flowpath downstream of the compressor;

an expansion device (262; 262') along the flowpath downstream of the first heat exchanger; and a second heat exchanger (264; 264') along the flowpath downstream of the expansion device.

8. The refrigeration system of claim 7 wherein:

a refrigerant charge comprises at least 50% carbon dioxide by weight.

9. The refrigeration system of claim 7 wherein:

there is no additional oil separator.

10. The refrigeration system of claim 7 wherein:

the crankshaft axis of rotation is within 20° of horizontal.

11. The system of claim 7 being a refrigerated transport system further comprising:

a container (324), the second heat exchanger being positioned to cool an interior (326) of the container.

12. The system of claim 7 being a fixed refrigeration system further comprising:

multiple refrigerated spaces (356); and a plurality of said second heat exchangers (264'), each being positioned to cool an associated said refrigerated space.

13. A method for operating the compressor of claim 1 wherein:

the motor is powered to drive the crankshaft and provide the reciprocal movement of the pistons;

the movement of the pistons creates suction in a suction passage;

the suction draws the refrigerant and the oil entrained in the refrigerant into the compressor through the inlet;

at least a portion of the refrigerant and entrained oil passes longitudinally toward the wall through a space between the rotor and the stator; and the means cause a deflection of the flow.

14. The method of claim 13 wherein:

the deflection of the flow causes separation and the coalescing of the oil.

15. A method for reengineering a configuration of a compressor or remanufacturing the compressor, the method comprising:

adding a lip to form the means for coalescing oil to produce the compressor of claim 1 or the configuration of said compressor.

16. The method of claim 15 wherein:

the adding of the lip comprises adding a plate (422) having a web (424) extending radially outward from a central aperture (426) to a curved peripheral portion (428).

17. The method of claim 15 wherein:

the adding of the lip comprises adding a channel in a casting mold to cast the lip.

18. The compressor of claim 1 wherein:

the means comprises a generally annular channel (134).

19. The compressor of claim 18 wherein:

the channel has a base (136) along the wall.

20. The system of claim 10 further comprising:

a bearing (60) mounted within the wall and supporting the crankshaft; and a check valve (98) in the wall below the bearing to permit flow from the motor compartment into the crankcase compartment.

* * * * *